US007253572B2

(12) United States Patent
Park et al.

(10) Patent No.: US 7,253,572 B2
(45) Date of Patent: Aug. 7, 2007

(54) ELECTROMAGNETIC INDUCED ACCELERATOR BASED ON COIL-TURN MODULATION

(75) Inventors: Won-taek Park, Seoul (KR); Vladimir Volynets, Gyeonggi-do (KR); Young-eal Kim, Gyeonggi-do (KR)

(73) Assignee: Samsung Electronics Co., Ltd., Gyenggi-do (KR)

( * ) Notice: Subject to any disclaimer, the term of this patent is extended or adjusted under 35 U.S.C. 154(b) by 66 days.

(21) Appl. No.: 11/288,386

(22) Filed: Nov. 29, 2005

(65) Prior Publication Data

US 2006/0113928 A1 Jun. 1, 2006

(30) Foreign Application Priority Data

Nov. 29, 2004 (KR) ..... 10-2004-0098486

(51) Int. Cl.
*H05H 7/00* (2006.01)

(52) U.S. Cl. ..... 315/501; 315/111.41

(58) Field of Classification Search ..... 315/501, 315/500, 39, 111.21, 111.41
See application file for complete search history.

(56) References Cited

U.S. PATENT DOCUMENTS 4,712,042 A * 12/1987 Hamm ..... 315/5.41
7,180,243 B2 * 2/2007 Secheresse et al. ..... 315/111.61

* cited by examiner

*Primary Examiner*—David Vu
(74) *Attorney, Agent, or Firm*—Sughrue Mion, PLLC

(57) ABSTRACT

An electromagnetic induced accelerator based on coil-turn modulation, including inner and outer cylinders with different diameters, the cylinders being coaxially disposed to form a channel which is a spatial portion therebetween; a discharging coil wound spirally inward along the upper surface of the channel for generating plasma by inducing a magnetic field and secondary current in the channel; and inner and outer coils wound helically around along the inner surface of the inner cylinder and the outer surface of the outer cylinder in parallel with each other for accelerating plasma in the direction of a common axis of the inner and outer cylinders by offsetting the magnetic field induced in the direction of the axis.

7 Claims, 4 Drawing Sheets

ELECTROMAGNETIC INDUCED ACCELERATOR BASED ON COIL-TURN MODULATION

This application claims priority under 35 U.S.C. § 119 from Korean Patent Application No. 2004-98486, filed on Nov. 29, 2004, the entire content of which is incorporated herein by reference.

BACKGROUND OF THE INVENTION

1. Field of the Invention

The present invention relates to an electromagnetic induced accelerator and, more particularly, to an electromagnetic induced accelerator using one single strand of coil to accomplish the purposes of generating plasma, inducing a magnetic field and secondary current and accelerating movement of plasma, respectively, or using a strand of coil to accomplish all of the purposes.

2. Description of the Related Art

An electromagnetic induced accelerator, or a plasma accelerator, operates to accelerate movement of plasma existing or generated in a spatial portion by electric and magnetic energy.

In the early stage, a plasma accelerator was developed for an ion engine of a rocket for long-distance space travel and nuclear fusion, but it has been used for a wafer etching technique in a semiconductor manufacturing process.

Plasma is the gaseous state of hot ionized material consisting of negatively charged electrons and positively charged ions with approximately equal concentrations of both, so that the total gas is in approximately charge neutral. Therefore, it is called the fourth state of matter besides the three states of matter-solid, liquid and gas.

As the temperature rises, most of all matter changes from a solid state, to a liquid state and then to gas state in turns. At several ten thousands of degrees (° C.), a gas splits into electrons and atomic nucleuses, resulting in a plasma state.

FIG. 1 is a cut-away perspective view of an electromagnetic induced accelerator in accordance with the related art.

With reference to FIG. 1, an electromagnetic induced accelerator comprises inner and outer circular loop coils 10, 20, a channel 40 contacting the inner circular loop coils 10 on its internal portion and outer circular loop coils 20 on its external portion, an outer cylinder 30, an inner cylinder 60 and a discharging coil 50 disposed underneath the channel 40.

The inner and outer loop coils 10, 20 are arranged coaxially in parallel to each other, and a current is applied to the coils 10, 20 circumferentially around the channel 40. A current is applied to the coils 10, 20 in the same direction, clockwise or counter-clockwise and this induces a magnetic field across the channel 40. In electromagnetic induced accelerators in accordance with the related art, inner and outer loop coils comprise a plurality of coils, respectively, and the coils 10, 20 are provided to gradually diminish the magnetic field induced in the channel 40 in the axial direction by reducing current flowing through each coil winding around in the axis direction. The magnetic field is induced across the channel 40 to be perpendicular to the axial direction and gradually decreases along the axial direction.

The magnetic field induced in the channel induces a secondary current in accordance with Maxwell's equation. Plasma generated in the channel 40 by the discharging coil 50 accelerates in the axial direction toward an exit 70 by the magnetic field induced across the channel 40 and the secondary current.

Such an electromagnetic induced accelerator in accordance with the related art is based on a B-field modulation method which accelerates plasma by causing a difference in magnetic pressure between the entrance side 80 and the exit 70 of the channel by applying large current and small current to the loop coils winding around the entrance side 80 and the exit side 70, respectively.

Accordingly, such B-field modulation requires a plurality of inner loop coils 10 installed in the inner cylinder 60 to independently apply different driving currents to each inner loop coil 10. It means that a plurality of pull-in wires for the inner loop coils 10 should be externally pulled in the inner cylinder 60. Accordingly, the number of the inner loop coils 10 to wind around the internal surface of the inner cylinder 60 is limited in case that the inner cylinder 60 is small in diameter. Further, influence of the pull-in wires to the magnetic field induced by the coils is so high. As a result, it is hard to induce the magnetic field as designed due to the coupling noises of the coils.

SUMMARY OF THE INVENTION

The present invention has been developed in order to solve the above drawbacks and other problems associated with the conventional arrangement. Therefore, a feature of the present invention is to provide an electromagnetic induced accelerator capable of inducing a strong magnetic field which does not harm a gradient of magnetic pressure by using a single coil and modulating the number of turns in each coil to accomplish the purposes of generating plasma, inducing magnetic field and secondary current and accelerating the plasma, respectively, or using only a single strand of coil to accomplish all of the purposes.

According to one aspect of the present invention, there is provided an electromagnetic induced accelerator based on coil-turn modulation, including inner and outer cylinders with different diameters, the cylinders being coaxially disposed to form a channel which is a spatial portion therebetween, a discharging coil wound spirally inward along the upper surface of the channel for generating plasma by inducing a magnetic field and secondary current in the channel, and inner and outer coils wound helically around along the inner surface of the inner cylinder and the outer surface of the outer cylinder, respectively, and being in parallel with each other for accelerating movement of plasma in the direction of the common axis of the inner and outer cylinders by offsetting the magnetic field induced in the direction of the axis.

The outer coil and the discharging coil may be physically connected.

The inner and the discharging coils may be physically connected.

The outer coil, the inner coil and the discharging coil may be physically connected.

The plasma may accelerate by causing a gradient of magnetic pressure by winding inner and outer coils with different denseness which is gradually lower in the direction along which the plasma accelerates.

The inner and the outer coils may be provided in such a way to strengthen the magnetic field which is perpendicular to the direction of the axis of the cylinders.

The electromagnetic induced accelerator in accordance with the present invention may be incorporated into a neutral beam dry etching apparatus used to etch a wafer in a semiconductor chip manufacturing process.

BRIEF DESCRIPTION OF THE DRAWINGS

The above aspects and features of the present invention will be more apparent by describing certain embodiments of the present invention with reference to the accompanying drawings, in which.

Figure 1:
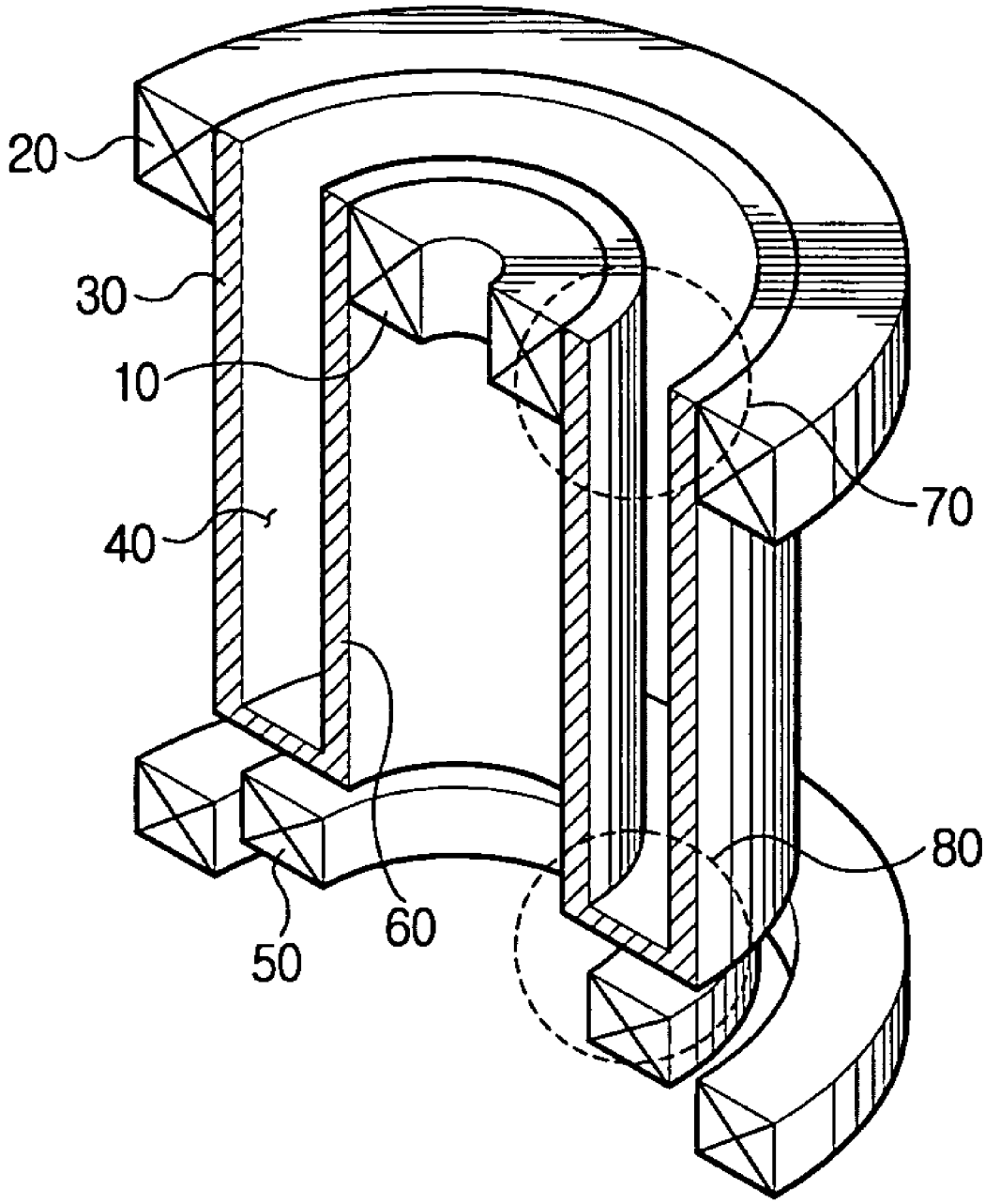
FIG. 1 (PRIOR ART)
FIG. 1 is a cut-away perspective view of an electromagnetic induced accelerator in accordance with the related art.

DETAILED DESCRIPTION OF THE ILLUSTRATIVE, NON-LIMITING EMBODIMENTS OF THE INVENTION

Certain embodiments of the present invention will be described in greater detail with reference to the accompanying drawings.

In the following description, like drawing reference numerals are used for the like elements even in different drawings. The matters defined in the description such as a detailed construction and elements are provided to assist in a comprehensive understanding of the invention. Thus, it is apparent that the present invention can be carried out without those defined matters. Also, well-known functions or constructions are not described in detail since they would obscure the invention in unnecessary detail.

Figure 2:
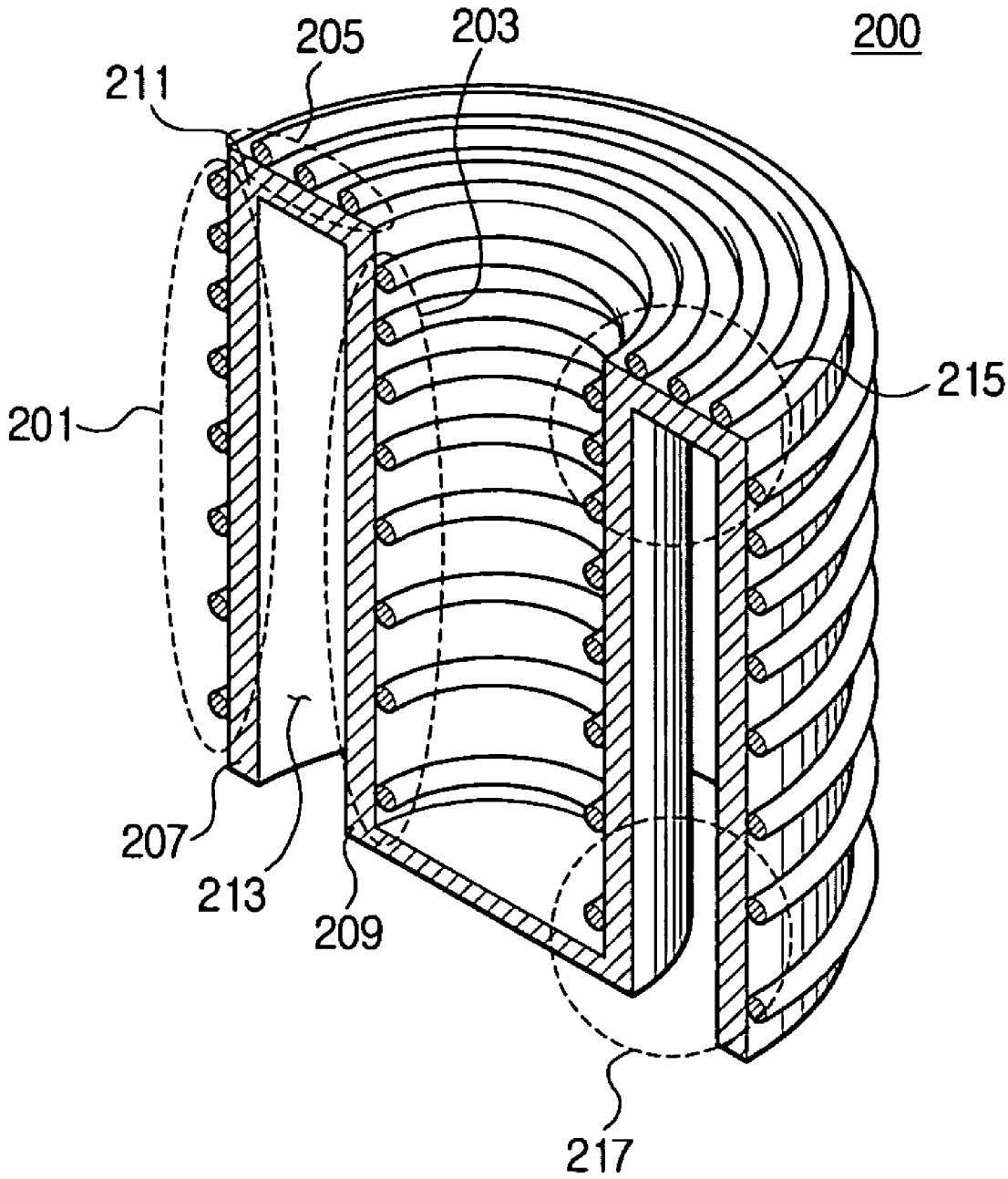
FIG. 2 is a cut-away perspective view of an electromagnetic induced accelerator in accordance with one embodiment of the present invention.

FIG. 2 is a cut-away perspective view of an electromagnetic induced accelerator capable of accelerating movement of plasma based on a coil-turn modulation method in accordance with one embodiment of the present invention.

An electromagnetic induced accelerator 200 in accordance with an exemplary embodiment of the present invention is an apparatus for accelerating movement of plasma and, more particularly, can be incorporated into a neutral beam dry etching apparatus for etching a wafer in a semiconductor device manufacturing process.

The accelerator 200 does not adopt a B-field modulation method which is well known in the art, in which a discharging coil and inner and outer loop coils, each comprising a plurality of coils, are separately provided to generate plasma, induce a magnetic field and a secondary current and accelerate plasma, but rather is based on a coil-turn modulation method which uses only one strand of coil to implement the discharging coil and the inner and outer coils.

Since the accelerator 200 in accordance with the exemplary embodiment of the present invention uses only one strand of coil, a driving circuit (not shown) for driving the accelerator 200 of the present invention can be simplified.

Referring to FIG. 2, the accelerator 200 of the present invention includes a strand of coil having three sections 201, 203 and 205, an outer cylinder 207 which is made of dielectric material, an inner cylinder 209 and a coupling unit 211.

The outer cylinder 207 and the inner cylinder 209 are coupled by the coupling unit 211 and form a channel 213 therebetween. The inner cylinder 209 is smaller than the outer cylinder 207 in diameter. The outer cylinder 207, the inner cylinder 209 and the coupling unit 211 are preferably, but not necessarily, made of dielectric material.

The channel 213 is a spatial portion in which plasma is generated and moves, and is formed along the axis direction of the cylinders 207, 209. The channel 213 includes an upper part 215 and a lower part with an exit 217. In case where the accelerator 200 is used to etch a wafer in a semiconductor device manufacturing process, the lower part with the exit 217 preferably faces a wafer.

The coil sections 201, 203 and 205 are connected in series to form a single strand of coil. The coil sections 201, 203, 205 denote an outer coil wound around the outer surface of the outer cylinder 207, an inner coil wound around the inner surface of the inner cylinder 209 and a discharging coil spirally wound inwardly on the upper surface of the coupling unit 211, respectively.

In accordance with another embodiment of the present invention, the coil sections comprised of the outer coil 201, the inner coil 203 and the discharging coil 205 are separated from each other and may be independently driven by different power supplies (not shown).

The outer, the inner and the discharging coils 201, 203 and 205 generate plasma and accelerate the generated plasma from the upper part 215 of the channel toward the exit 217 by causing a gradient of magnetic pressure in the channel 213.

A method of winding a coil incorporated in the accelerator 200 in accordance with the exemplary embodiment of the present invention will be described below with reference to FIGS. 3A and 3B.

Figure 3A:
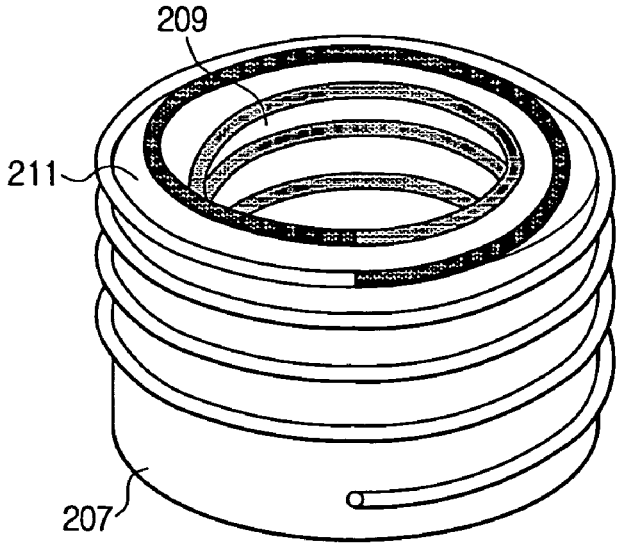
FIG. 3A is a perspective view of an electromagnetic induced accelerator in accordance with one embodiment of the present invention.

FIG. 3A schematically illustrates an electromagnetic induced accelerator based on coil-turn modulation in accordance with the exemplary embodiment of the present invention. Like reference numerals denote like elements in FIG. 2 and FIG. 3A.

Referring to FIG. 3A, the coils 201, 203 and 205 are helically wound upward around the outer surface of the outer cylinder 207 from the exit 217 to the upper part 215 of the channel, then wound spirally inward along the upper surface of the coupling unit 211, and finally wound helically downward along the inner surface of the inner cylinder 209 from the upper part 215 of the channel to the exit 217.

In FIG. 3A, the coil sections 201, 203 and 205 wind counter-clockwise when viewing from the end of the coil 201 but may also wind clockwise.

Figure 3B:
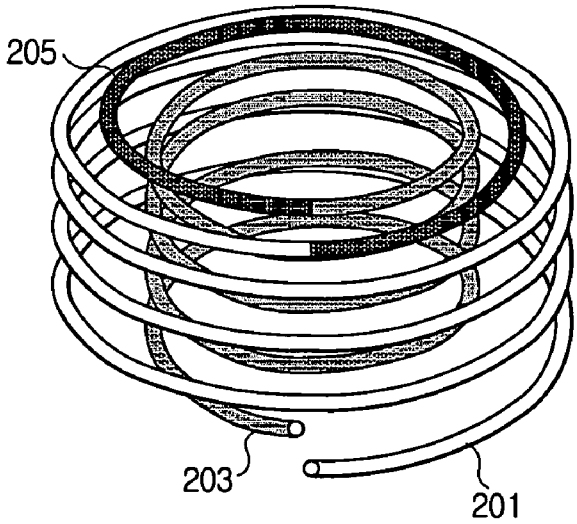
FIG. 3B is a perspective view of a coil for showing a winding feature of the coil depicted in FIG. 3A.

FIG. 3B schematically illustrates a winding feature of a coil incorporated into the accelerator of the present invention shown in FIG. 3A.

Referring to FIG. 3B, the outer coil 201, the inner coil 203 and the discharging coil 205 are connected in series to form a single strand.

The inner coil 203 is made of a single strand of wire regardless of the number of turns, so that it has only one pull-in wire externally pulled in the inner cylinder 209. Accordingly, a diameter of the inner cylinder 209 is not limited due to the number of pull-in wires, so that the inner cylinder 209 may be realized in a small size. As the diameter of the inner cylinder 209 decreases, the width of the coupling unit 211, and in turn a size of the channel 213, becomes greater. This increases the number of turns in the discharging coil 205 along the upper surface of the coupling unit 211, thereby increasing the effective discharging space.

Further, the accelerator in accordance with the present invention is also advantageous in that it is hardly affected by pull-in wires since the coil has only one piece of pull-in wire.

The winding pitch of the outer and inner coils 201, 203 may be adjusted to form a gradient of magnetic pressure in the channel 213. Preferably, but not necessarily, the outer and inner coils 201, 203 are wound with a small winding pitch at the upper part 215 of the channel 213 and with a large winding pitch near the exit 217. That is, the gradient of the magnetic pressure in the channel 213 is caused by the winding pitches of the coil, or denseness of windings in coil. Such a gradient of the magnetic pressure accelerates movement of plasma from a spot with high magnetic pressure toward a spot with low magnetic pressure.

The winding pitches of the outer and inner coils 201, 203 can be changed linearly or stepwise at regular intervals from the upper part 215 of the channel 213 to the exit 217.

It is, however, not necessary that winding pitches of the outer coil 201 and inner coil 203 correspond to each other over its position.

On one hand, the outer and inner coils 201, 203 can have the same winding pitch as the discharging coil 205.

In accordance with a further embodiment of the present invention, the outer coil 201, the inner coil 203 and the discharging coil 205 can be physically or electrically separated from each other, and different driving currents can be applied to the three separated coils 201, 203 and 205, respectively and independently. Even in such a case, the ways and pitches of winding the coils may be the same as described with reference to FIG. 3B.

Further, the outer, inner and discharging coils 201, 203, 205 can be implemented with two strands of wires. For example, the outer coil 201 and the discharging coil 205 are connected but the inner coil 203 is separated from the others 201 and 205. On the other hand, the inner coil 203 and the discharging coil 205 can be connected and the outer coil 201 is separated from the others 205 and 203.

The operation of the electromagnetic induced accelerator based on coil-turn modulation in accordance with the present invention will be described below in detail.

Figure 4:
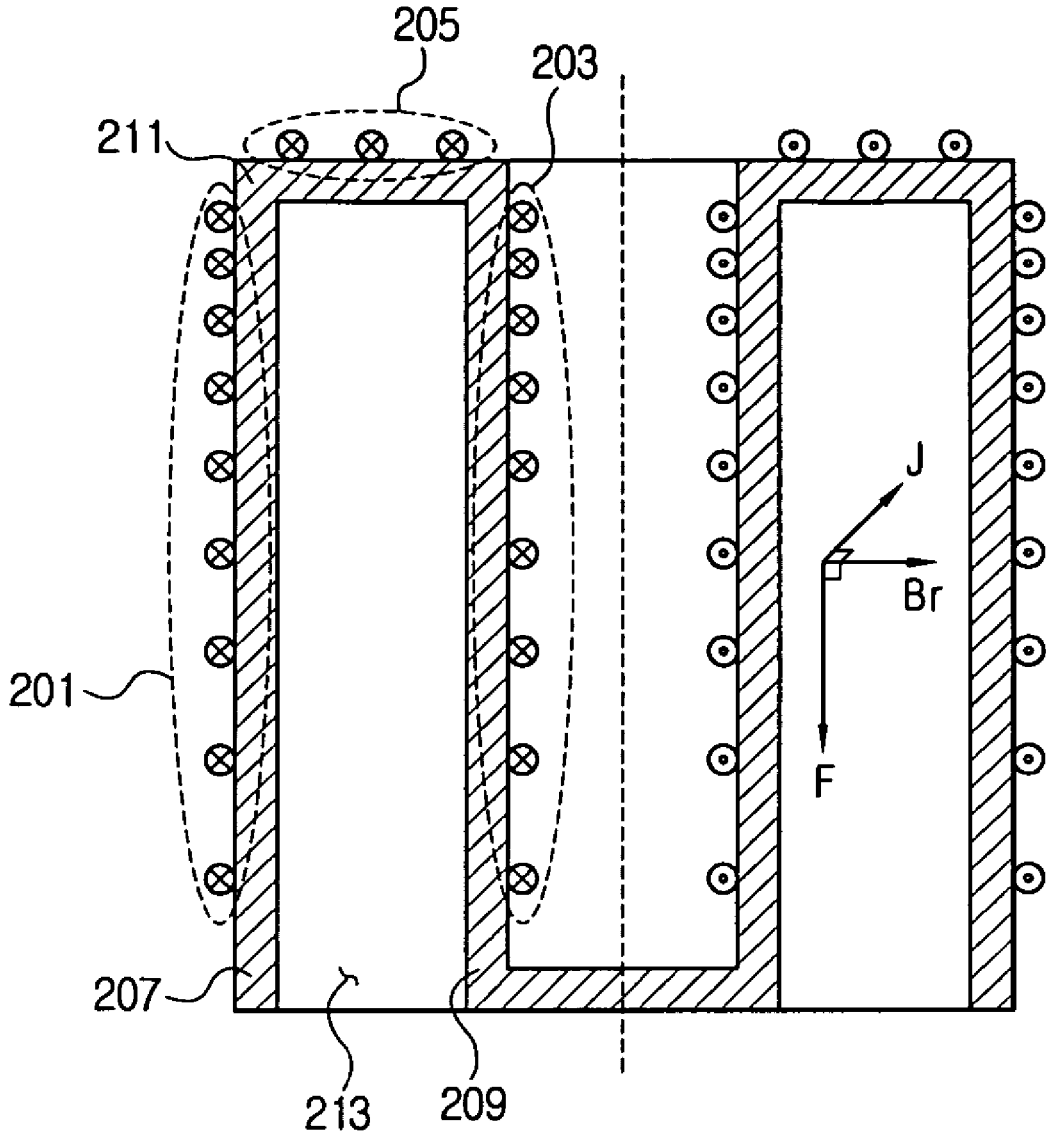
FIG. 4 is a schematic cross-sectional view of an electromagnetic induced accelerator in accordance with one embodiment of the present invention.

FIG. 4 is a schematic cross-sectional view of an electromagnetic induced accelerator based on coil-tun modulation in accordance with the present invention. Like reference numerals in FIG. 4 denote like elements as shown in FIG. 2.

In FIG. 4, a circle represents coils 201, 203, 205, and symbols "●" and "x" indicate the direction of current flowing through the coils 201, 203, 205. Therefore, the dot symbol "⊙" indicates the direction of current flowing out from the ground, and the symbol "ⓧ" indicates the direction of current flowing into the ground. Referring to FIG. 4, current flows through the coils 201, 203, 205 clockwise in the axis direction of the outer and inner cylinders 207, 209, when viewing from the upper part 215 of the channel.

The current flowing through the coils 201, 203 and 205 may be alternating current (AC) with a predetermined frequency.

When current flows through the coils 201, 203, 205, a magnetic field is induced around the coils 201, 203, 205 in accordance with Ampere's right-hand screw rule. The magnetic field induced by the outer coil 201, the inner coil 203 and the discharging coil 205 may have the same direction or different directions over their positions. At this time, the magnetic field in the axis direction is offset since the directions are opposite, but the magnetic field Br induced across the channel is strong.

The magnetic field Br induced in the channel 213 induces secondary current J in accordance with Maxwell's equation. Accordingly, referring to FIG. 4, the secondary current J is induced in the opposite direction to the current flow of the coils 201, 203, 205.

A gas existing in the channel 213 or being externally introduced into the channel 213 is turned into plasma by an electric field induced by the secondary current J.

At this time, if the energy of electrons generated by the electric field in the channel 213 is greater than the ionization energy of the gas, plasma is generated as particles that are ionized by electron collision. The discharging coil 205 highly affects generation of the plasma.

Further, in accordance with Equation 1 below, electromagnetic force F which accelerates plasma from the upper part 215 of the channel to the exit 217 is caused by the magnetic field Br induced across the channel 213 and the secondary current J.

$$\vec{F} = \vec{J} \times \vec{B} \qquad \text{[Equation 1]}$$

Plasma tends to move as a whole itself by the Coulombic force which exerts over long distance, and such movement is accelerated toward the exit 217 by the electromagnetic force F. As a gradient of the magnetic pressure is caused by denseness difference of the windings of the outer and inner coils 201, 203 wound around the outer and inner cylinders 207, 209, the movement of the plasma is more highly accelerated.

Unlike the conventional methods, since the outer and the inner coils 201, 203 wound around the inner and outer cylinders 207, 209 are formed of a single strand of a wire and the same driving current flows through the coils 201, 203 in the accelerator of the present invention, the gradient of magnetic pressure is not affected by coupling of coils.

As described above, in accordance with the present invention, when accelerating movement of plasma by electromagnetic inducement, generating plasma, inducing magnetic field and secondary current and accelerating the generated plasma are achieved by modulating denseness of turns in a coil.

Further, it is capable of producing a designed strong magnetic field with a gradient of magnetic pressure which is not distorted even though there is coupling between currents induced in the channel in which plasma is generated and accelerated.

Further, the accelerator in accordance with the present invention is advantageous in that it has a simplified driving circuit compared with the conventional accelerator because it uses only one strand of coil and one power supply.

Still further, since the accelerator of the present invention has only one pull-in wire of the coil, the pull-in wire can be easily installed in an inner cylinder and hardly affects operation of the accelerator.

Yet still further, since the number of pull-in wires to be externally pulled into the inside of the inner cylinder is a few, the inner cylinder can be designed to have a small size in diameter. As a result, effective discharging space increases.

The foregoing embodiments and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. An electromagnetic induced accelerator based on coil-turn modulation, comprising:

inner and outer cylinders coaxially disposed with different diameters to form a channel which is a spatial portion between the inner and outer cylinders;

a discharging coil wound spirally inward along an upper surface of the channel for generating plasma by inducing a magnetic field and a secondary current in the channel; and inner and outer coils wound helically around along an inner surface of the inner cylinder and an outer surface of the outer cylinder, respectively, and being in parallel with each other for accelerating plasma in a direction of a common axis of the inner and outer cylinders by offsetting the magnetic field induced in the direction of the common axis.

2. The accelerator as claimed in claim 1, wherein the outer coil and the discharging coil are physically connected.

3. The accelerator as claimed in claim 1, wherein the inner coil and the discharging coil are physically connected.

4. The accelerator as claimed in claim 3, wherein the outer coil, the inner coil and the discharging coil are physically connected.

5. The accelerator as claimed in claim 1, wherein the plasma is accelerated by causing a gradient of magnetic pressure by winding the inner and outer coils with denseness which is gradually lower in the direction along which the plasma accelerates.

6. The accelerator as claimed in claim 1, wherein the inner and outer coils are provided in such a way to strengthen the magnetic field which is perpendicular to the direction of the axis of the cylinders.

7. A neutral beam dry etching apparatus which etches a wafer in a semiconductor chip in a dry manner, using the accelerator as claimed in claim 1.

* * * * *